US009631406B2

(12) United States Patent
Chartier et al.

(10) Patent No.: US 9,631,406 B2
(45) Date of Patent: Apr. 25, 2017

(54) MAGNETIC GATE LATCH

(71) Applicant: Weldon Industries, Inc., Tampa, FL (US)

(72) Inventors: Joel Chartier, Lakewood Ranch, FL (US); Christopher Paradies, Tampa, FL (US)

(73) Assignee: Weldon Industries, Inc., Tampa, FL (US)

( * ) Notice: Subject to any disclaimer, the term of this patent is extended or adjusted under 35 U.S.C. 154(b) by 0 days.

(21) Appl. No.: 15/154,006

(22) Filed: May 13, 2016

(65) Prior Publication Data

US 2016/0326784 A1 Nov. 10, 2016

Related U.S. Application Data

(63) Continuation of application No. 13/758,630, filed on Feb. 4, 2013, now abandoned.

(51) Int. Cl.

| | |
|---|---|
| ***E05C 17/56*** | (2006.01) |
| ***E05C 19/16*** | (2006.01) |
| ***E05B 15/02*** | (2006.01) |
| ***E05B 65/00*** | (2006.01) |
| ***E05C 1/06*** | (2006.01) |

(52) U.S. Cl.

CPC ..... *E05C 19/163* (2013.01); *E05B 15/025* (2013.01); *E05B 65/0007* (2013.01); *E05C 1/06* (2013.01); *Y10T 292/096* (2015.04); *Y10T 292/1022* (2015.04)

(58) Field of Classification Search

CPC ..... E05C 19/163; E05C 1/06; E05B 15/025; E05B 65/0007; Y10T 292/1022; Y10T 292/096

USPC ..... 292/215.5

See application file for complete search history.

(56) References Cited

U.S. PATENT DOCUMENTS

| | | | | |
|---|---|---|---|---|
| 4,339,853 A * | 7/1982 | Lipschitz | E05B 73/0017 | 24/136 R |
| 6,765,330 B2 * | 7/2004 | Baur | F16B 5/0614 | 292/144 |
| 2005/0225098 A1 * | 10/2005 | Kliefoth | E05C 19/163 | 292/251.5 |
| 2008/0296915 A1 * | 12/2008 | Clark | E05B 13/101 | 292/251.5 |

* cited by examiner

*Primary Examiner* — Kristina Fulton
*Assistant Examiner* — Thomas Neubauer
(74) *Attorney, Agent, or Firm* — Christopher Paradies; Paradies Law P.A.

(57) ABSTRACT

A magnetic gate latch comprises magnetic materials and a latching mechanism attracted into a keeper when the gate latch is closed by a first magnetic force and retained in a unlatched position by a second magnetic force. For example, the latching mechanism comprises a pin without a spring or other biasing mechanism biasing the spring in a direction opposite of a magnet in the keeper assembly. In one example, the pin comprises a magnet on an end of the pin opposite from the keeper assembly, which is attracted toward a ferromagnetic material when the pin is retracted into the housing.

11 Claims, 18 Drawing Sheets

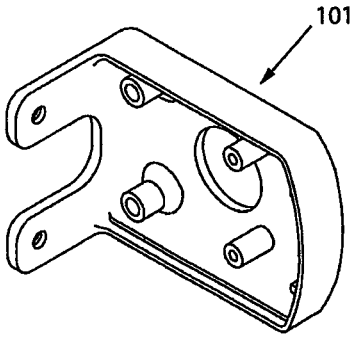
FIG. 5A
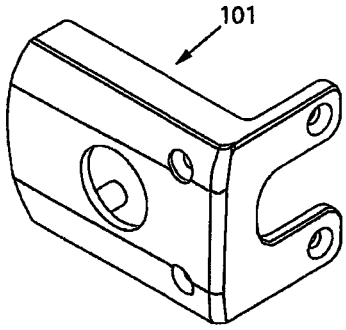
FIG. 5B
FIG. 6B
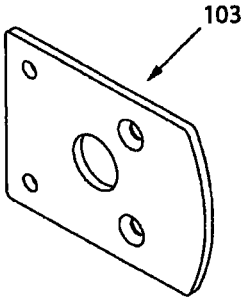
FIG. 6A
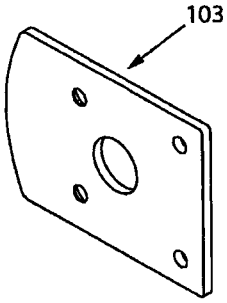

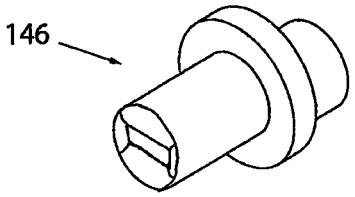
FIG. 10B
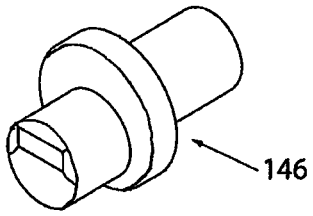
FIG. 10C
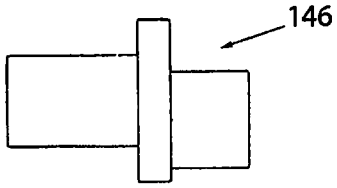
FIG. 10A
FIG. 9B
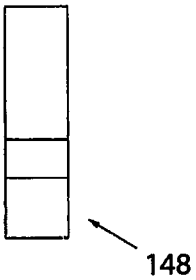
FIG. 9A
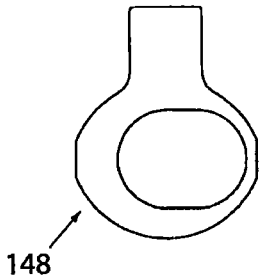
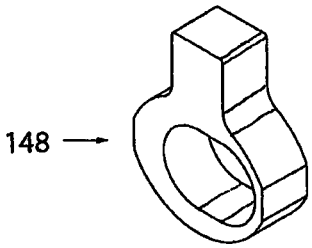
FIG. 9C

149

A
B
SECTION B-B

SECTION C-C

SECTION A-A

C

FIG. 16B
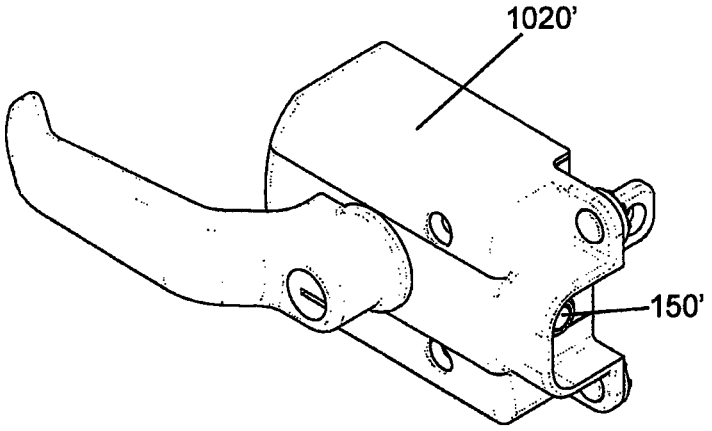
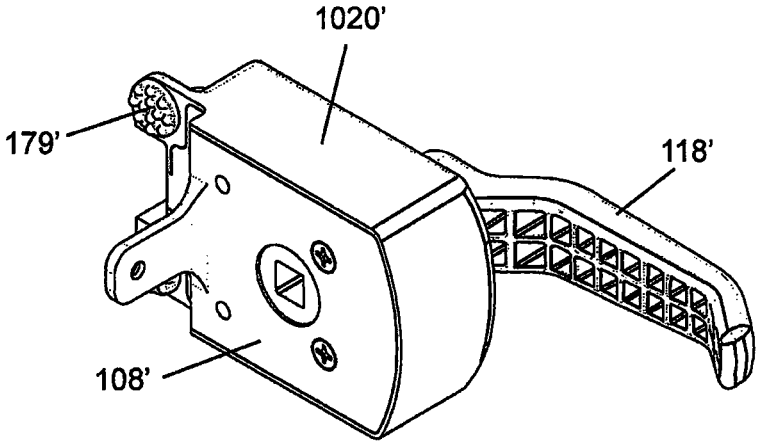
FIG. 16A

FIG. 17C
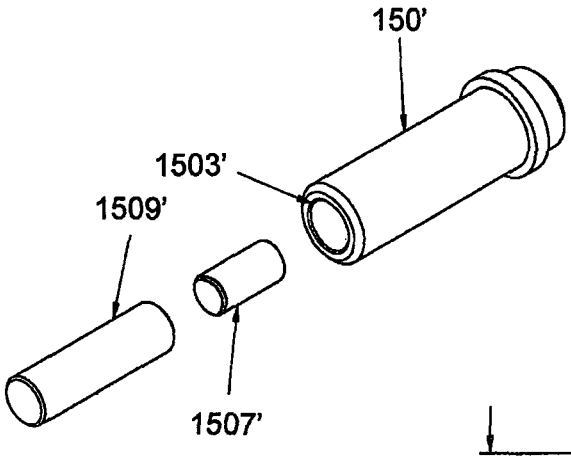
FIG. 17D
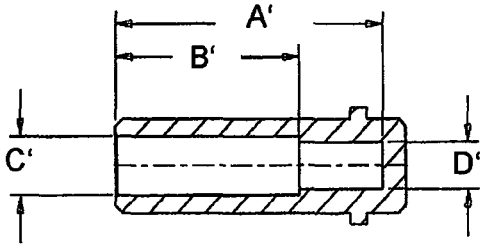
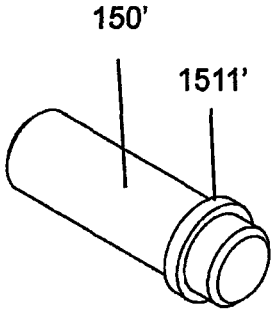
FIG. 17A
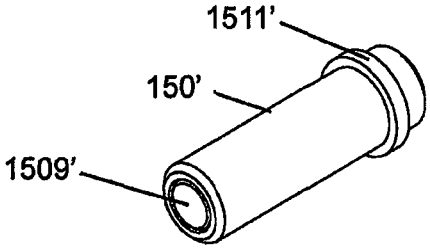
FIG. 17B

FIG. 19C
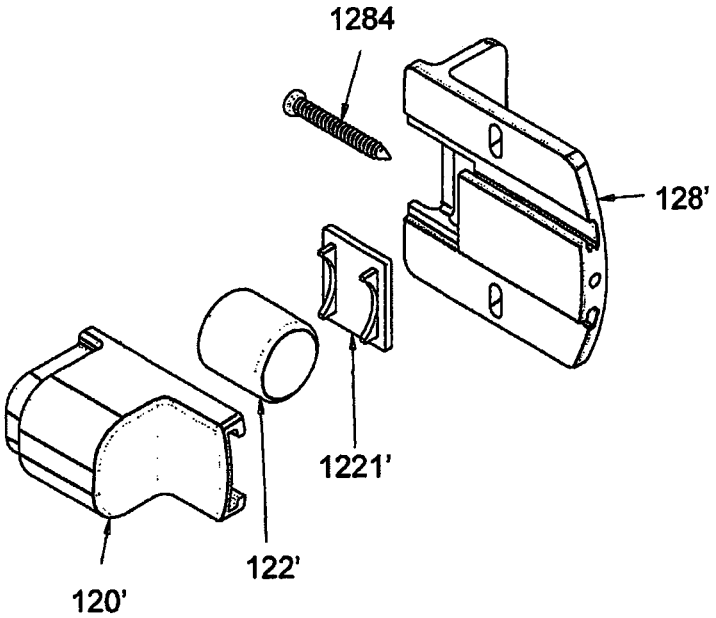
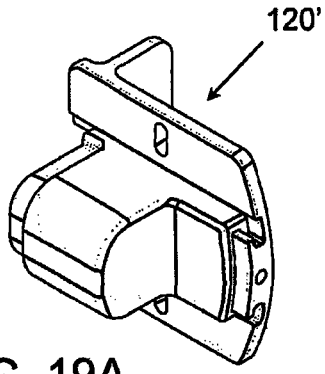
FIG. 19A
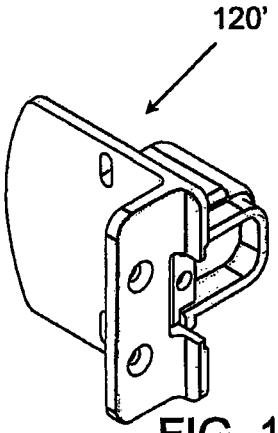
FIG. 19B

FIG. 20B
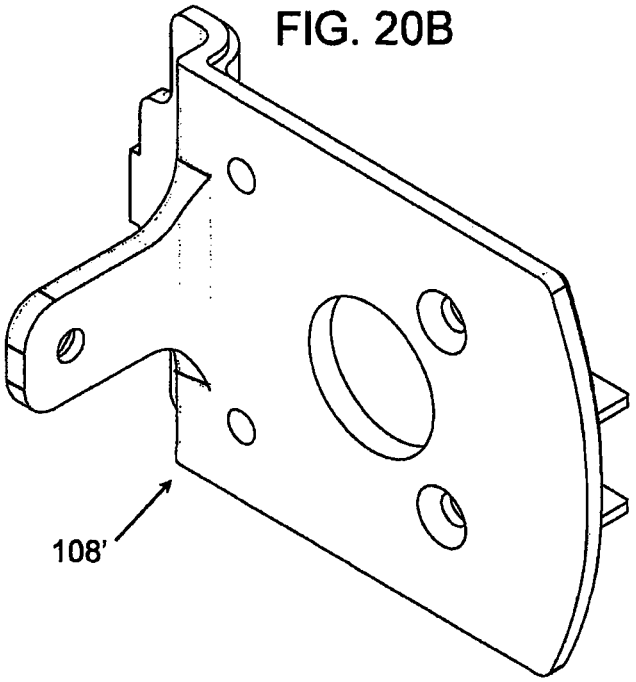
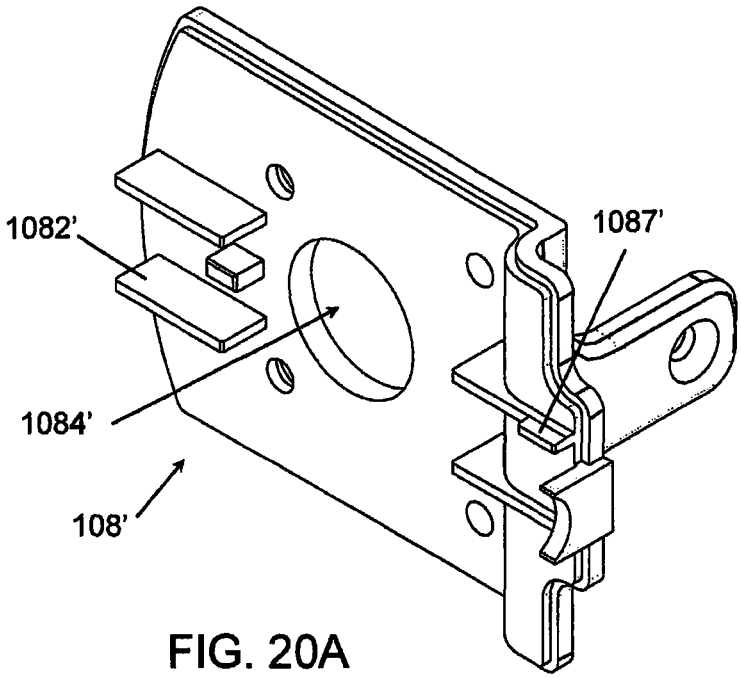
FIG. 20A

MAGNETIC GATE LATCH

CROSS RELATED APPLICATIONS

This application is a continuation application of U.S. application Ser. No. 13/738,630 filed Feb. 4, 2013 which is incorporated by reference herein in its entirety.

FIELD OF THE INVENTION

The field relates to magnetically latchable locks and latches.

BACKGROUND

U.S. Pat. No. 7,390,035 discloses a magnetic gate latch having a magnet disposed in a keeper assembly. The magnet attracts a pin in a housing with a handle, when the pin is disposed over the magnet in the keeper assembly, latching the pin in the keeper. A handle or handles are operatively coupled with the pin to retract the pin from the keeper assembly, and a helical coil spring biases the pin to retain the pin within the housing when the handle is in a neutral position, until the gate closes and the pin is positioned over the magnet. The strength of the spring must be matched with the strength of the magnet to allow the pin to be polled toward the magnet when the gate closes but must be strong enough to retain the spring in the housing, when the spring is released from the magnet. It is believed that the relatively weak spring, which remains in compression most of the time, while the gate is latched, is a shortcoming of this design.

U.S. Pat. No. 7,044,511 discloses a magnetic gate latch having a magnet disposed in a housing with a handle that actuates a lever which displaces a pin in relation to the magnet By displacing the pin in relation to the magnet, the handle is capable of unlatching the pin from the housing. When the gate closes, the pin, which is housed in a keeper assembly, is attracted by the magnet into a portion of the housing, latching the gate. The pin is biased by a spring in the keeper assembly and the spring is compressed while the gate is dosed. The spring mu# be weaker than the magnetic force of attraction. Thus, the disclosed magnetic gate latch is susceptible to some of the same mechanical problems as the design in U.S. Pat. No. 7,390,035. When the handle is in the neutral position and the gate closes, the magnet in the housing with a handle attracts the pin and engages the pin in the housing with the handle, latching the gate.

Also, U.S. Pat. No. 5,362,116 discloses a magnet in a keeper assembly, which actuates the latching of a pin that is attractable by the magnet The pin is disposed in a housing with a handle and is biased by spring. Other magnetic gate latches are disclosed in U.S. Pat. Nos. 3,790,197; 5,114,195; International Publ. No. WO 03/067004; and Japanese Abstract for application JP7233666; Pat Publ. JP 3-212589; JP5340149; JP3039580; JP8210001 and JP3191187. None of these references disclose a simple mechanism that can be used with gates that is both functional and robust enough for extended use in the field.

SUMMARY

A magnetically latchable gate latch comprises a mechanism for latching a gate latch including a keeper and a mountable housing, each comprising a magnet. In one example, a strong permanent magnet is disposed in the keeper for attracting a mechanism made of a ferromagnetic material, when the housing and the keeper are aligned upon closing the gate. The magnet and ferromagnetic material are attracted one to the other by magnetic force. The magnetic force is sufficient such that, when the gate doses, the mechanism for latching the gate latch is attracted toward the keeper, latching the gate latch. This allows the gate to dose and latch without resistance of a spring-loaded latching mechanism, which is normal for mechanical latching mechanisms. Therefore, the magnetically latchable gate latch has all the benefits of known magnetic gate latches, and in addition, arrangement of a magnet in both the keeper and housing overcomes shortcomings with use of a spring to bias the latching mechanism in the closed position. In one example, the latching mechanism is not biased by any spring force when in the latched and unlatched positions.

In one example, the mechanism is a pin having a first end comprised of a ferromagnetic material, and the first end is disposed such that the first end is attracted to a permanent magnet retained within the keeper. When the gate is closed and the first end is disposed opposite of the keeper, the magnetic force of the permanent magnet in the keeper attracts the ferromagnetic material of the latching mechanism displacing the latching mechanism, latching the gate latch. A second portion of the latching mechanism, such as an opposite end of a pin, if the latching mechanism takes the shape of a pin, may comprise a second magnet For example, the second magnet may be a permanent magnet magnetically weaker than the strong permanent magnet retained in the keeper. Alternatively, the second magnet may be coated or covered by a dielectric material, which weakens a magnetic attraction between the second magnet and a ferromagnetic material, such as a ring or strip of a ferromagnetic steel, within the mountable housing. Alternatively, the second portion of the latching mechanism may be a ferromagnetic material, and the strip or ring may be made of a more weakly magnetically attractive material than the strong permanent magnet retained in the keeper. Alternatively, the strip may have regions of high ferromagnetic attraction to the latching mechanism and regions of lower or no ferromagnetic attraction in order to change the level of magnetic force on the latching mechanism, depending on the angle of the handle. Whichever alternative is adopted, a pin or other latching mechanism may be retained in the housing by the weaker magnet and ferromagnetic material when the gate is open and/or the handle is turned, and when the gate closes and the handle is in the neutral position, then pin or other latching mechanism is drawn to the magnet in the keeper. For example, a ferromagnetic material of a pin and a strong permanent magnet retained in the keeper are aligned, providing a strong attractive force between the pin and the magnet, latching the gate latch. For example, a pin may extend from the housing and may be latched by the keeper, when aligned across from the keeper when the gate is closed.

For example, the handle of the gate latch is rotated to open the latch of the gate latch by engaging a retractor mechanism. In one example, the retractor mechanism is coupled to the handle such that the retractor mechanism pulls the latching mechanism away from the keeper and into the housing of the gate latch, releasing the gate latch from the keeper, when the handle is turned in either rotational direction. As the gate is opened and the handle is released, a spring may return the handle, the retractor mechanism or both thereof to a first position. Inane example, a first spring acts on the retractor mechanism and a second spring acts on the handle. Neither of the springs need to have their biasing force matched with the magnetic force of the permanent magnet in the keeper, because neither act on the pin when the handle is in its neutral position. Herein, the neutral position is the position in which the handle returns when not acted on by a user.

Instead of spring or other mechanical bias force acting on the pin, a magnetic force retains the position of the pin within the housing, at least when the handle is turned and as the retractor mechanism and handle are returned to a neutral position. Herein, the neutral position of the retractor mechanism is the position to which the retractor mechanism returns when it is not engaging the latching mechanism. The magnetic force retains the latching mechanism in position within the housing, even while the retractor mechanism and handle return to their neutral position. Then, a weak magnetic attraction keeps the latching mechanism within the housing until is disposed over the strong permanent magnet in the keeper, which attracts the latching mechanism into a latched position with the keeper. In any of the alternative examples, the latching mechanism, such as a pin, is retained within the housing by the weaker magnetic force until the gate doses and the latching mechanism is attracted to the keeper by the stronger magnetic force between the latching mechanism and the strong permanent magnet in the keeper. In yet another alternative example, an even stronger magnetic force results from a pair of magnets attracted one to the other, one in the keeper and one in the latching mechanism. For example, the latching mechanism may be a pin with permanent magnets on both of its opposite ends or may be a pin with a permanent magnet only at the end closer to the keeper.

In one example, the stronger magnetic force between the keeper and the latching mechanism is the result of a dielectric material coating or barrier layer, or a thicker barrier or more highly dielectric material, disposed between a magnetic material and ferromagnetic material within the housing as a retaining mechanism, compared with the stronger force of magnetic attraction between the keeper and the latching mechanism. By selecting the attractive forces of the magnets and/or thicknesses of dielectric materials and/or degree of dielectric of any barrier layer, an operationally effective balance of magnetic attraction between a retention mechanism within the housing and between the keeper and a latching mechanism is established, such feat the magnetic attraction between the keeper and the latching mechanism causes the latching mechanism to become latched when the latching mechanism is disposed opposite of the keeper (i.e. when the gate closes). One advantage is no spring is used to bias the latching mechanism. Another advantage of one example is that the force on the latching mechanism can be varied depending on the position of the handle and the retracting mechanism.

A device for latching and unlatching a gate may comprise a first magnet disposed in a keeper, and a gate latch assembly, wherein the gate latch assembly and the keeper are arranged to work cooperatively in latching and unlatching the gate. For example, the gate latch assembly may comprise a second magnet disposed within the gate latch assembly, a latching mechanism, and a housing. The latching mechanism may be coupled to the housing, such feat, when the gate latch assembly and the keeper are installed on the gate, the latching mechanism is capable of latching the gate in a latched position by extending from the housing, engaging the keeper, when the keeper and the gate latch assembly are installed on the gate. The latching mechanism is capable of unlatching the gate to an unlatched position by withdrawing the latching mechanism from engagement with the keeper. The second magnet may be arranged within the gate latch assembly such that the latching mechanism is retained in the unlatched position by a force of magnetic attraction provided by the second magnet, when the gate latch assembly is not in the latched position. For example, the second magnet, such as a permanent magnet in the form of a hockey puck or a strip, may be fixed on the latching mechanism or on a component within the housing, such as an actuating mechanism. If the latching mechanism comprises a pin, then the pin or a portion of the pin may be made of a ferromagnetic material, such as steel. The ferromagnetic material is magnetically attractable to the first magnet in the keeper drawing the pin into engagement with the keeper, and the second magnet may be fixed on the end of the pin within the housing on the end opposite of the end engaging the keeper.

The second magnet, which is disposed within the housing, may be attracted magnetically toward a ferromagnetic material disposed within the housing such that the pin is retained in a retracted position when the gate is opened and when in the process of closing, until the pin is again positioned over the magnet in the keeper in the closed position. The magnet in the keeper provides a strong attractive force on the pin, which operatively engages the pin with the keeper. The strong attractive force of the keeper is sufficient to overcome any magnetic force retaining the pin in the retracted position.

For example, the handle of a gate latch assembly operatively engages an actuator mechanism, which operatively engages the retractor, which operatively engages the latching mechanism, for unlatching the latching mechanism from the keeper. The keeper comprises a magnet for latching the latching mechanism under influence of a magnetic force between the keeper and the latching mechanism.

In one example, a ferromagnetic material is fixed on the actuator mechanism and the second magnet is fixed on the latching mechanism, magnetically attracting the latching mechanism toward the actuator mechanism. The ferromagnetic material may be fixed on a portion of the actuator mechanism in one or more areas of the actuator mechanism.

Far example, an arcuate strip may be fixed on the actuator mechanism that includes one or more ferromagnetic areas of the arcuate strip. For example, the arcuate strip may be a composite material comprised of a ferromagnetic material and a non-ferromagnetic material, such as steel foils or steel strips combined with a dielectric material, such, as glass filled nylon or an epoxy resin. A portion of the surface of the arcuate strip may be made of a ferromagnetic material and another portion may be made of a dielectric, which may be optionally backed by a ferromagnetic material. For example, use of a dielectric in the central portion of an arcuate strip may be provided to apply a lower magnetic force of attraction between the arcuate strip and the latching mechanism, when the handle and the actuator is in a neutral position. For example, the first portion of the arcuate strip may be disposed between a second and third portion comprised of a ferromagnetic material. Then, as the actuator is displaced from the neutral position, the second magnet comes into direct contact with either the second portion or the third portion of the arcuate strip, increasing the force of magnetic attraction between the second magnet and the arcuate strip. By increasing the magnetic attraction, the retractor may return forward without affecting the position of the latching mechanism, even if there is some level of friction between the retractor and the latching mechanism during its forward movement If the latching mechanism comprises a pin, there is no need for the pin to be biased in any direction by a spring or any other mechanical biasing mechanism, because the pin is retained in its retracted position by a magnetic force between the pin and another component in the housing, such as an arcuate strip. Without a spring for biasing the latching pin, the design of the retractor may be simplified, and the gate latch may be operatively configured to provide a surprisingly functional and durable magnetic gate latch.

BRIEF DESCRIPTION OF THE DRAWINGS

FIGS. 5A-6B illustrate a housing for a handle on an opposite side of a gate from the housing including the latching mechanism and the retractor mechanism.

FIGS. 9A-10C illustrate an example of additional components of a magnetic gate latch.

FIGS. 11A-K (letter I intentionally omitted) illustrates an example of a sliding mechanism of the retractor mechanism.

FIGS. 16A-B illustrates a portion the example of FIG. 13.

FIGS. 17A-D illustrate a latch pin contained within the portion illustrated in FIGS. 16A-B; FIGS. 17A-D illustrate (A) a perspective rear view, (B) a perspective front view, (C) an exploded view and (D) a cross sectional view along the cylindrical axis.

FIGS. 20A-B illustrate a bade plate for the housing in FIGS. 14A-B.

DETAILED DESCRIPTION

The examples described and the drawings rendered are illustrative and are not to be read as limiting the scope of the invention as it is defined by the claims.

Figure 1:
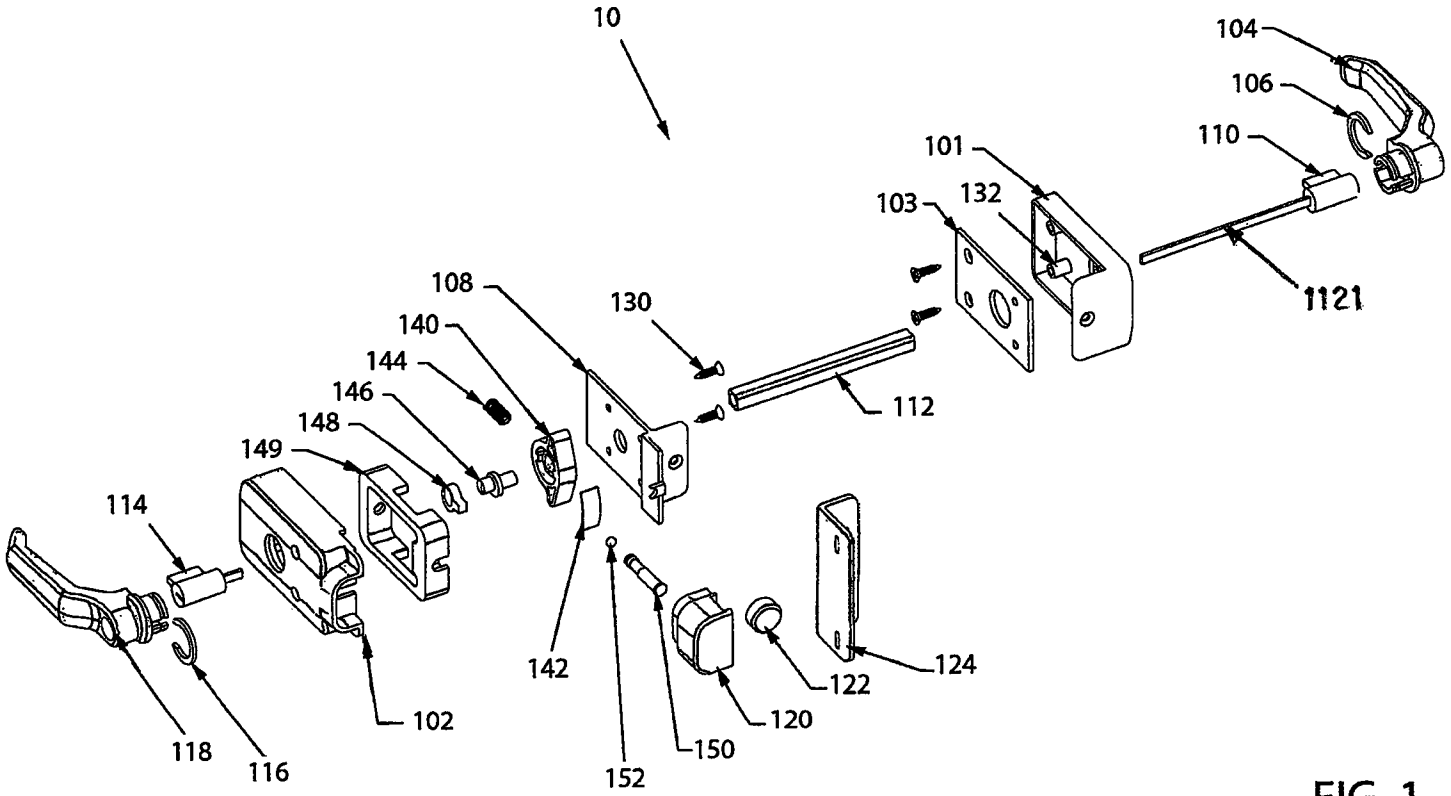
FIG. 1 illustrates an exploded, perspective view of an example of a magnetic gate latch.

In one example, such as illustrated in FIG. 1, a gate latch 10 includes a magnetic latching mechanism. For example, a rear latch housing 101 and mounting plate 103 may be mounted on one side of a gate, and a front latch housing 102 and mounting plate 108 may be mounted on the opposite side of the gate. A plurality of fasteners 130 may be used to join the housings 101,102 and the mounting plates 103,108, such as a screw 130 and screw stud 132 combination.

Handles 104, 118 may be coupled to the housings 101, 102, such as by plastic retainer rings 106, 116, for example. Locks 110, 114, may be coupled one to the other by a spline passing through a transfer sleeve 112, such that the operation of one locking mechanism 110, 114 is capable of locking or unlocking the other.

Within the housing of FIG. 1, a latching mechanism comprises a pin retractor 149 that operatively engages a latch pin 150 for retracting the latch pin 150 when the pin retractor 149 is retracted by operation of one of the handles 104, 118. For example, a cam actuator 140 may provide dual cams for engaging a portion of the pin retractor 149 when either handle 104, 118 is rotated either clockwise or counterclockwise.

The cam actuator 140 may be coupled to the kindles 104, 118 by the transfer sleeve 112. A pawl actuating cam 146 and a locking pawl 148 may be provided to couple the locking splines, for example. A Miming mechanism, such as a helical coil spring 144 disposed between the front housing 102 and a wall of the pin retractor 149, such that the pin retractor is biased towards direction of the latch pin 150.

Alternatively or in addition to a spring in contact with the pin retractor 149, a biasing mechanism may be applied to the cam actuator 140, for example, such as torsion spring (not shown but a well known biasing mechanism for returning a handle to a neutral position).

For example, a keeper 120 may comprise a keeper housing containing a permanent magnet 122 and may be mounted to a keeper bracket 124. The keeper provides an indentation, hollow or recess for accommodating the latch pin 150, latching the latch pin when the gate is closed. The latch pin comprises a ferromagnetic material, such as steel, which is attracted to the magnet 122 within the keeper 120.

In FIG. 1, the latch pin 150 comprises a dielectric shielded permanent magnet 152 embedded in an end of the latch pin 150 opposite of the keeper. A steel strip 142 is joined to a surface of the cam actuator 140, such as by fusing or by an adhesive. The dielectric shielded permanent magnet 152 provides an attractive force operative for retaining the pin 150 in contact with the strip 142, until the pin 150 is aligned with the keeper 120. When the pin 150 is aligned with the keeper 129, then the magnetic attraction between the magnet 122 and the pin 150 is stronger than the magnetic attraction between the strip 142 and the dielectrically shielded magnet 152 embedded in the opposite end of the pin 150.

Alternatively, the strip 142 may be a magnetic strip and the pin may comprise a ferromagnetic material such as a ferromagnetic steel, and the dielectric coated magnet may be omitted. In either alternative, the magnetic force of attraction between the magnet 122 and the pin 150 may be selected to be much stronger than the magnetic force of attraction between the strip and the pin in the housing.

The pin retractor 149 and/or the cam actuator 140 is biased by a biasing mechanism that returns the cam actuator 140 and the pin retractor 149 to a first position, after operation of one of the handles displaces the pin retractor to a second position that displaces the pin into the housing and into dose proximity or contact with a the strip 142. The pin is retained in the second position by a magnetic attraction between the pin and the strip while the gate is open, even though the pin retractor returns to the first position due to the biasing mechanism when the handles are released or returned to a neutral position.

Figure 2:
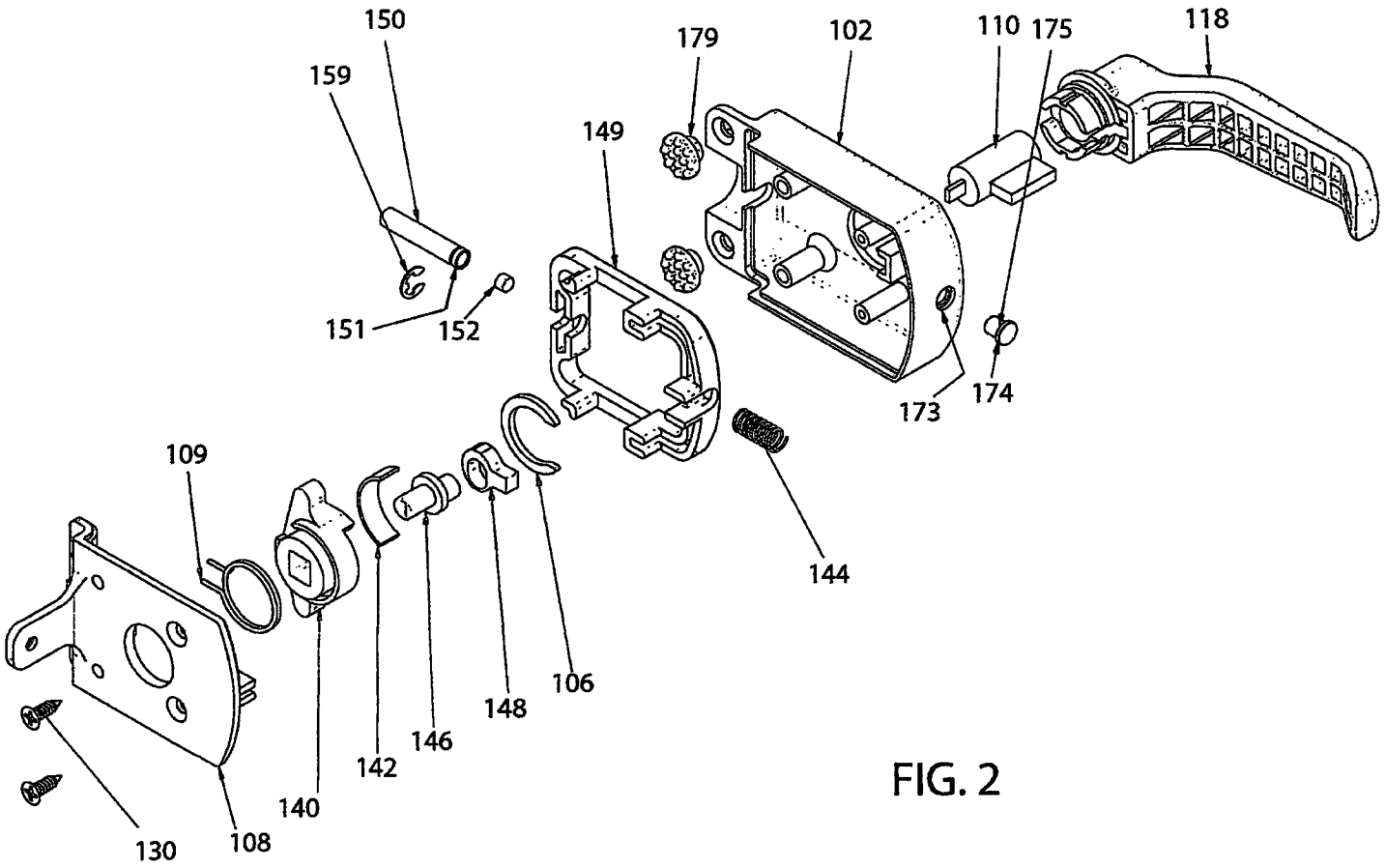
FIG. 2 illustrates an exploded, perspective view of another example of a housing of a magnetic gate latch.
Figures 2A, 2B:
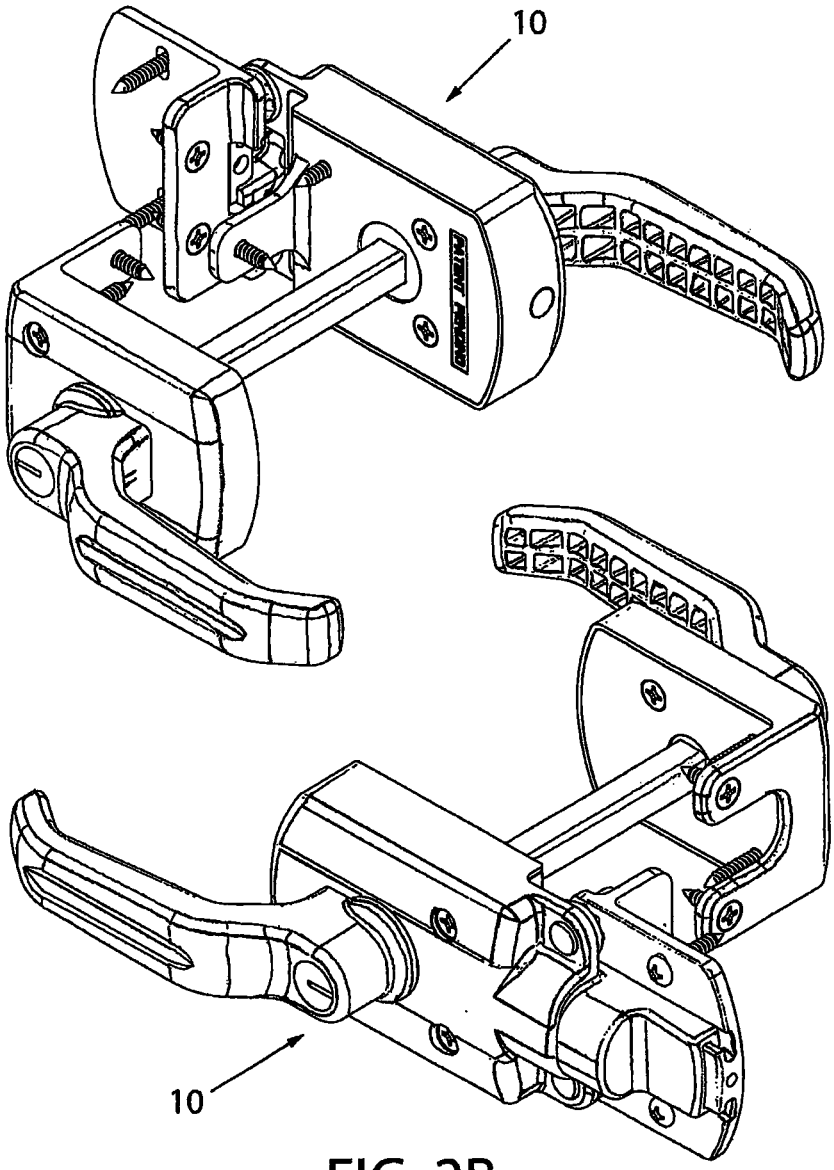
FIGS. 2A-2B illustrate an example of an assembled magnetic gate latch.
Figure 12B:
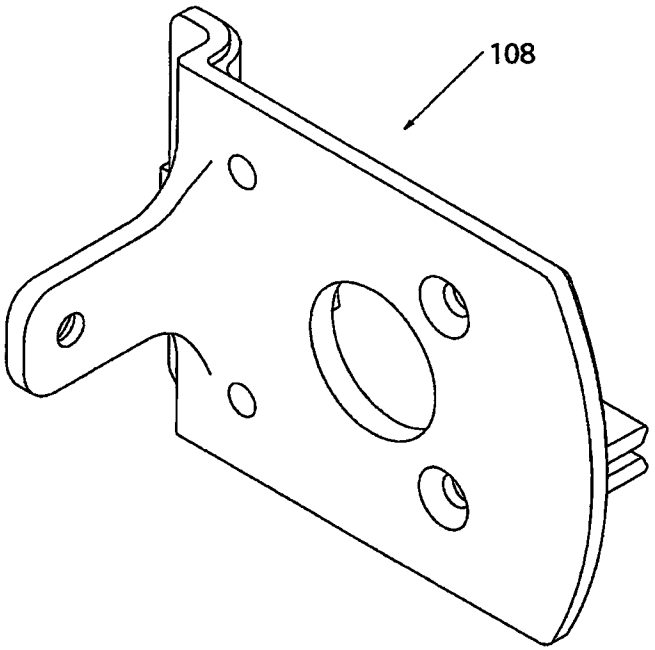
FIG. 12A-B illustrate an example of component of a housing far the latching mechanism and the retractor mechanism, which may be operatively arranged to retain and guide the sliding mechanism of the retractor during retraction of the latching mechanism.
Figure 12A:
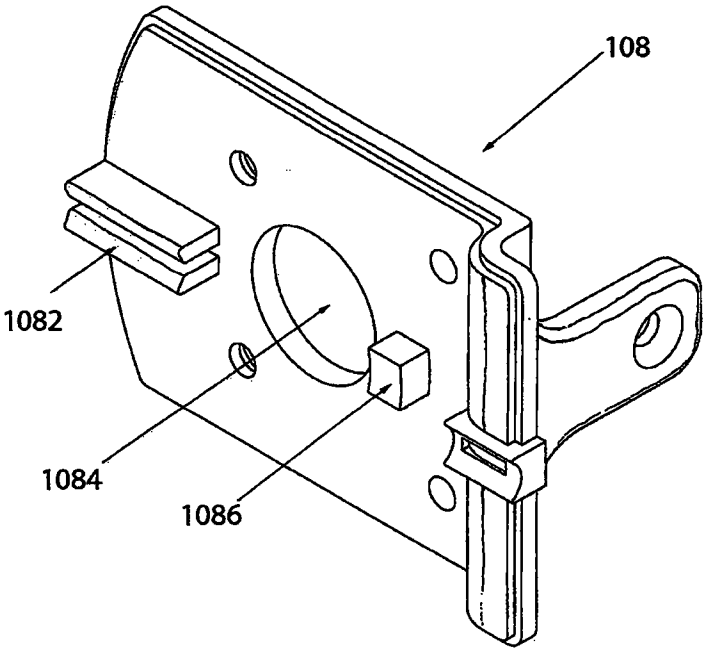

In FIG. 2, another example of a magnetic gate latch is shown with similar components labeled with the same identification number. The mounting plate 108, which is shown in detail in FIGS. 12A and 12B, includes a guide rail 1082 for engaging with recessed portions in the pin retractor 149 and a spring retainer 1086 for engaging with a torsion spring 109 that returns the handle 118 to a neutral position when the user releases the handle 118. In this example, the torsion spring 109 engages the spring retainer 1086 and the cam actuator 140. The cam actuator 140 is operatively engaged by the handle 104 attached to the housing 101 and operatively engages the transfer sleeve 112, which operatively engages the handle 118 on the opposite side of the gate. The torsion spring 109 is capable of returning the cam actuator 140 and both handles 104,118 to the neutral position. Optionally, a biasing mechanism, which may be a helical coil spring 144 retained on a spring retaining plug 175, is arranged to operatively engage the pin retractor 149 to return the pin retractor 149 to a neutral position when the handles 114,118 are released. The spring retaining plug 175 has a flange 174 that matingly engages a Recess in the housing 102 and may be retained ferae mechanically or by an adhesive. The neutral position for the pin retractor 149 is forward, such feat the pin retractor 149 does not engage the retainer 159, which is operatively engaged at a groove in the pin 150. When in the neutral position, the pin retractor 149 does not hold the pin 150 in its retracted position, freeing the pin 150, which is then retained by the force of magnetic attraction between the magnet 152 and the strip 142. For example, the pin 150 may be retained within the housing 161 by this force of magnetic attraction, at least during the return of the pin retractor 159 and the handles 104,118 to their respective neutral positions. Also, bumpers 179 are provided feat engage retaining holes in the housing 101 where a portion of the housing overlaps a portion of keeper 120, as illustrated in FIGS. 2A and 2B, for example.

Figure 3C:
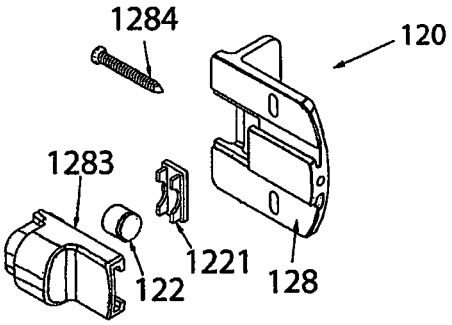
FIGS. 3A-4B illustrate an example of a keeper assembly.
Figure 3A:
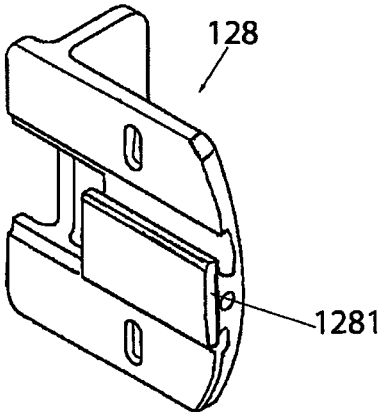
Figure 3B:
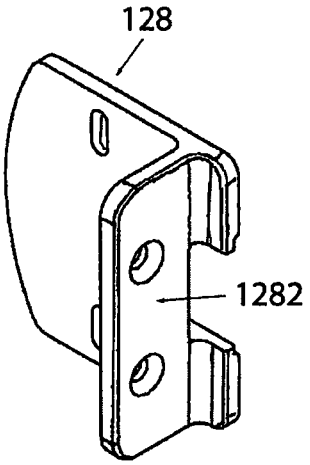
Figure 4A:
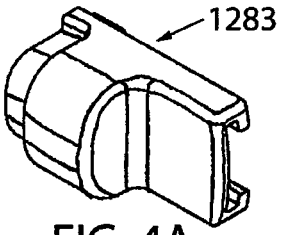
Figure 4B:
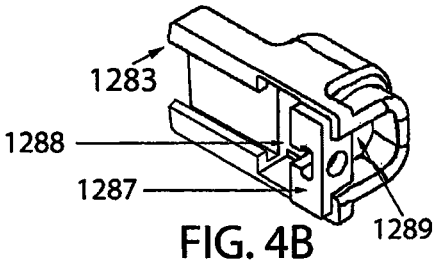
Figure 8A:
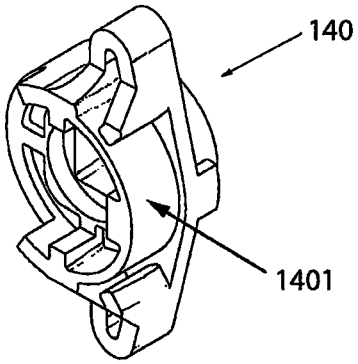
FIGS. 7A-8B illustrate an example of components of a retractor mechanism.
Figure 8B:
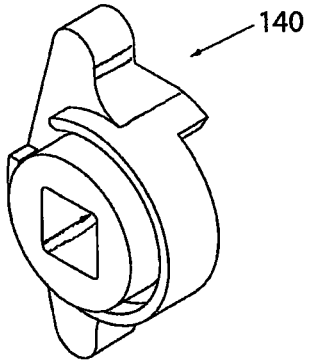

FIGS. 3A and 3B illustrate a mount 128 of a keeper 120 that includes a flange 1282, which is used for attaching the mount 128 on a structure, such as to a gate or a gate post A slider bracket 1281 engages a magnet housing 1283, which is adjustable along the slider bracket 1281 using a screw 1284, as illustrated in FIG. 3C. As illustrated in FIG. 4B, the magnet housing includes a screw retainer 1287, which defines a slot for insertion of the head of the screw 1284, and a hole for insertion of a tool to adjust the screw, positioning the magnet housing 1283 on the slide bracket 1281. The channel in magnet housing 1283 as illustrated in FIG. 4B accommodates the slide bracket 1281 within the channel of the magnet housing 1283. As illustrated in FIG. 3C, the magnet 122 is retained in the magnet housing 1283 by a magnet retainer 1221, which fits into a recessed portion 1288 of the magnet housing 1283. A pin keeper recess 1289 is defined in the magnet housing 1283 and is positioned by the screw 1284 such feat the pin 150 is retained within the recess 1289 when the gate is closed and the pin is drawn by magnetic force into the recess 1289 of the magnet housing 1283.

FIGS. 5A-6B illustrate detailed views of features of a housing 101 and a mounting plate 103 for mounting on the side of a gate opposite of the housing 102 that contains the mechanism for engaging the pin 150. A lockable handle 104 includes a locking mechanism 110 and is mounted to the housing 101 by a C-retainer 106. A spline 1121 operatively couples the locking mechanism 110 with a locking mechanism 114 in the opposite handle 118, allowing a user to lock or unlock the magnetic gate latch from either side of the gate. A pawl actuating cam 146 and a locking pawl 148, as illustrated in detail in FIGS. 9A-10C, may be provided to couple the locking splines of the locking mechanisms 110, 114, for example.

Figure 7C:
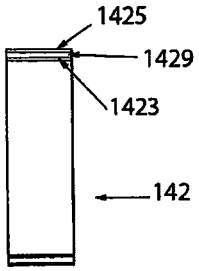
Figure 7B:
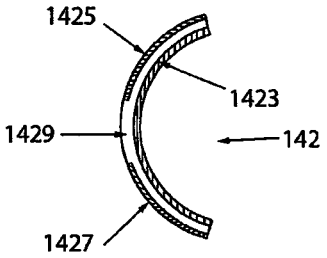
Figure 7A:
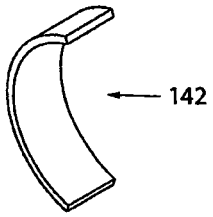

FIG. 7A is a proportional view of an arcuate strip 142. FIG. 7B illustrates an example of a cross section of a composite arcuate strip 142, having the form of the arcuate strip illustrated in FIG. 7A, which may be monolithic, a particle-filled or fiber-filled composite or a layered composite. In this example, the cross-hatched portions are a ferroelectric metal or metal-filled portion, such as steel strip, steel wool composite, steel-fiber composite or steel-particle composite, which attracts the magnet 152 of the pin 150 toward the strip 142. An optional backing strip 1423 may be provided that provides for a force of attraction between the backing strip 1423 and the magnet 152, even when the cam actuator 140 returns to its neutral position, such feat the magnet 152 is contacting an electrically insulating portion 1429 (i.e. dielectric) of the strip 142. Magnetically attractive portions 1425,1427 are disposed on the surface of the strip 142 to provide a stronger force of magnetic attraction between the pin 150 and the actuator 140, when the handle is turned by the user in either direction. The actuator 140 has a strip retaining portion 1401 for retaining the strip 142 on a surface of the retaining portion 1401.

Figures 11A, 11B, 11C, 11D, 11E, 11F, 11G, 11H, 11J, 11K:
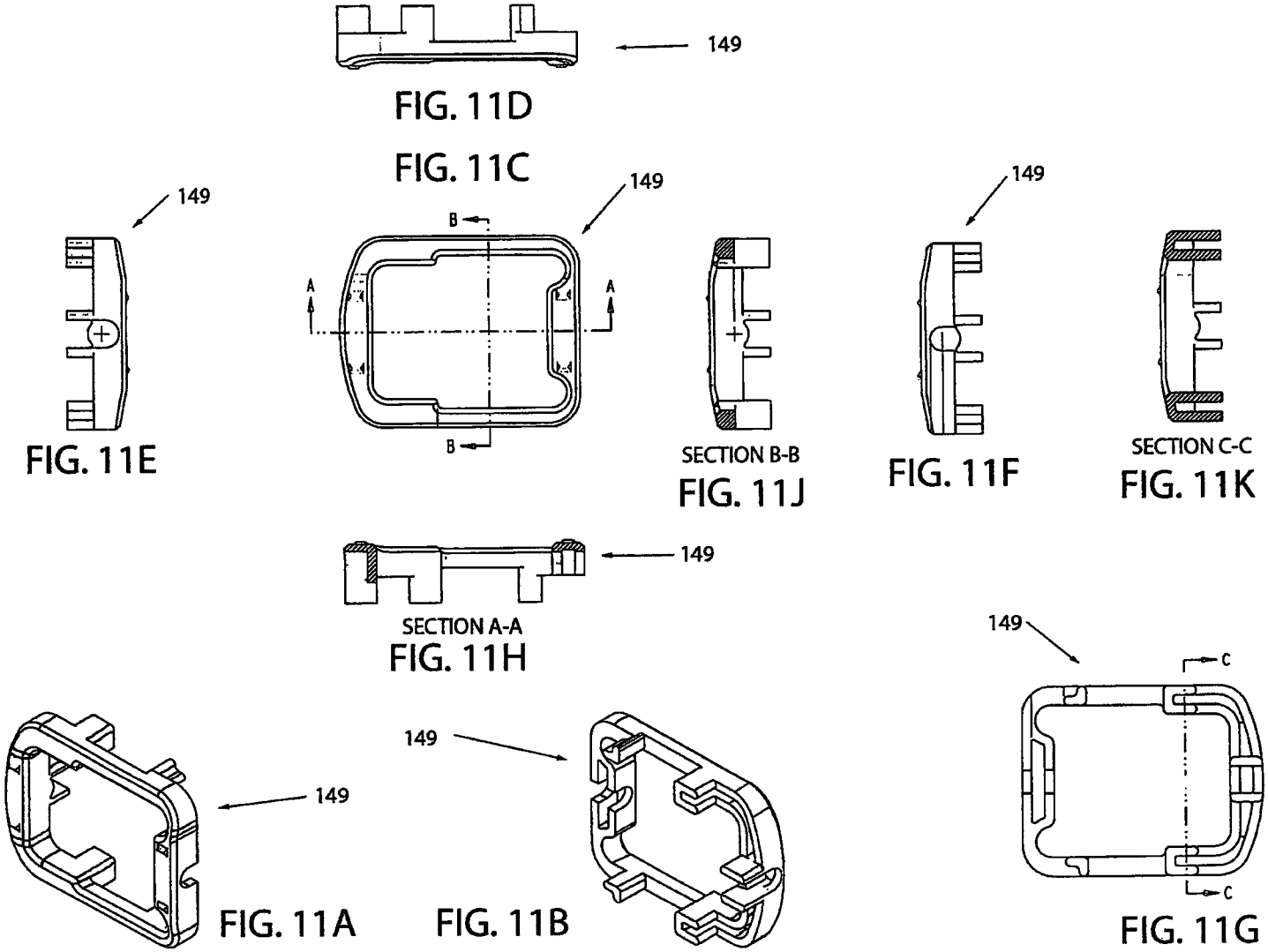

FIGS. 11A-K (letter I intentionally omitted) illustrates views of a pin retractor 149. FIGS. 11A-B illustrate perspective view of opposite sides of the pin retractor 149. Cross sectional views are illustrated in FIGS. 11H, 11J and 11K. FIG. 11C illustrates a top view of the retractor 149. Opposite ends of the retractor are illustrated in FIGS. 11E and 11F. A side view is illustrated in FIG. 11D and a bottom view is illustrated in FIG. 11G. The form and materials of the pin retractor 149 is formed to slide operatively when engaged in the housing 102 on the mounting plate 108 or a portion thereof.

Figure 13:
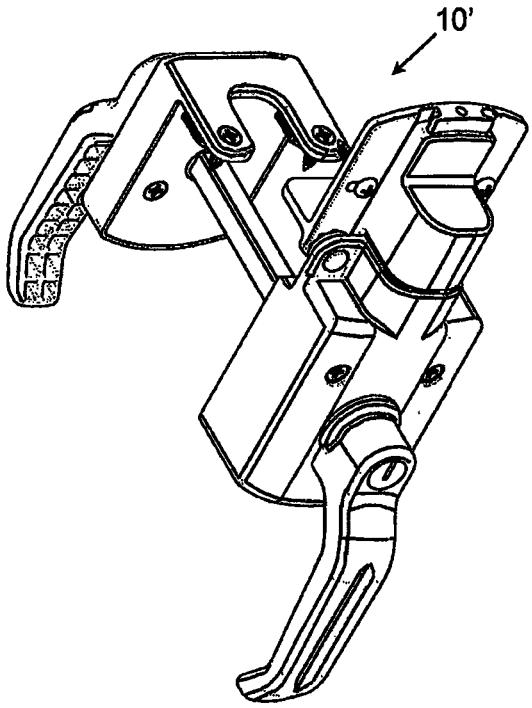
FIG. 13 illustrates another example of a magnetic gate latch.
Figure 14A:
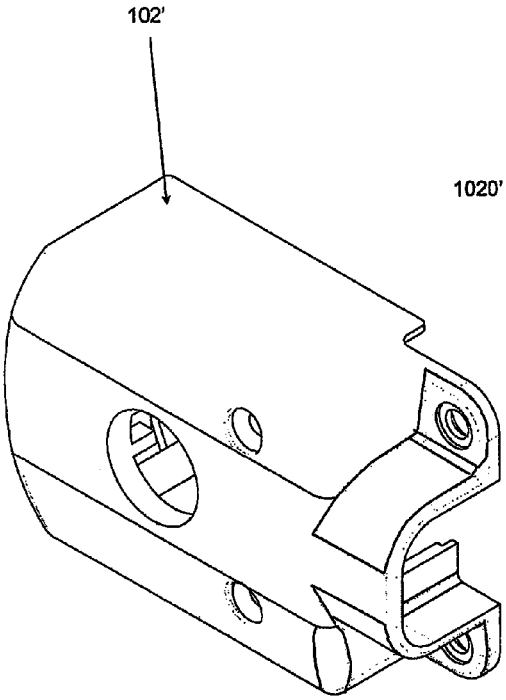
FIGS. 14A-B illustrate a housing.
Figure 14B:
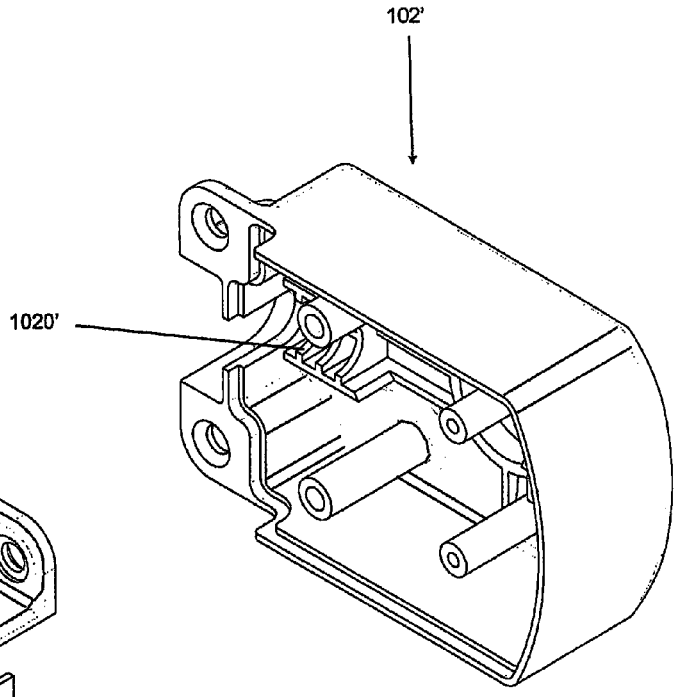
Figure 15:
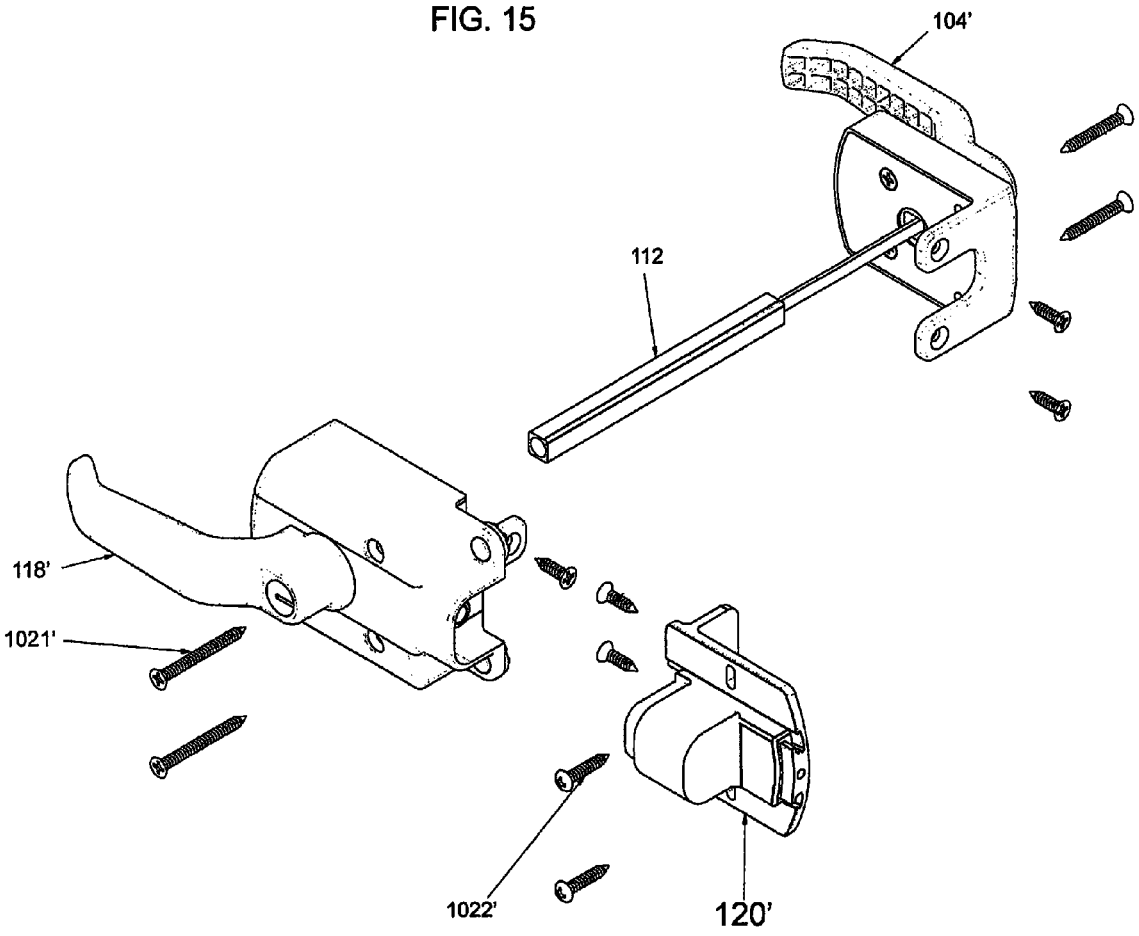
FIG. 15 illustrates a partially exploded view of the example of FIG. 13.

FIG. 13 illustrates another example of a magnetic gate latch 10' that provides for a magnetic latching mechanism. FIGS. 14A-B illustrate a housing 102' having a structure 1020' for retaining a latching pin within the housing. FIG. 15 illustrates a partially exploded view of the example of a magnetic gate latch showing fasteners 1021', 1022' and the keeper assembly 120' aligned with the housing 102'. FIGS. 16A-B illustrate a perspective view of one portion of a magnetic gate latch showing bumpers 179' made of a material such as an elastic or foam material a bade plate 108', a housing 1020', a handle 118' and a latch pin 150'. FIG. 17A-D illustrates a detail view of the latch pin 150', which may comprise a pin housing with a collar 1511', a ferromagnetic pin 1509' (such as a core made of a ferromagnetic material, e.g. a zinc plated steel core), and magnetic core 1507' as illustrated in the exploded view of FIG. 17C. FIG. 17D illustrates a cross section of the pin housing along the cylindrical axis of the pin housing having a bore hole with a length A' extending nearly the entire length of the pin housing, a length B' having a largo: diameter C' than smaller diameter D' of the remainder of the length A'. The smaller diameter D' is sized to accommodate the diameter and length of the magnetic core 1507', such as a neodymium-iron-boron permanent magnetic core having a diameter of one quarter inch and a length of one-half inch. The larger diameter may be sized for press fit of the ferromagnetic pin of a diameter 0.312 inches and a length B' of about 1.075 inches.

Figure 18:
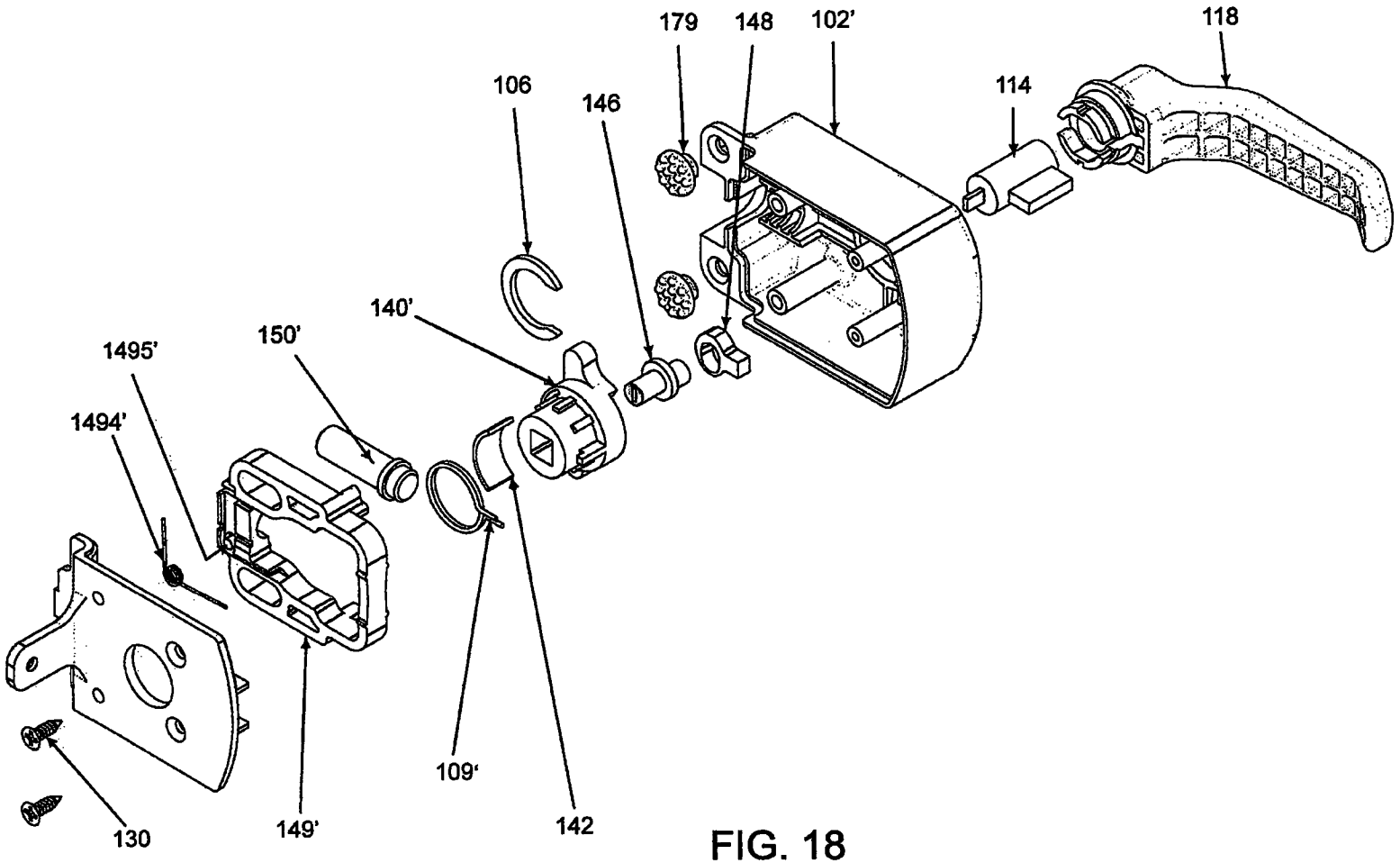
FIG. 18 illustrates an exploded, perspective view of the portion illustrated in FIGS. 16A-B FIGS. 19A-C illustrate a keeper.
Figure 21:
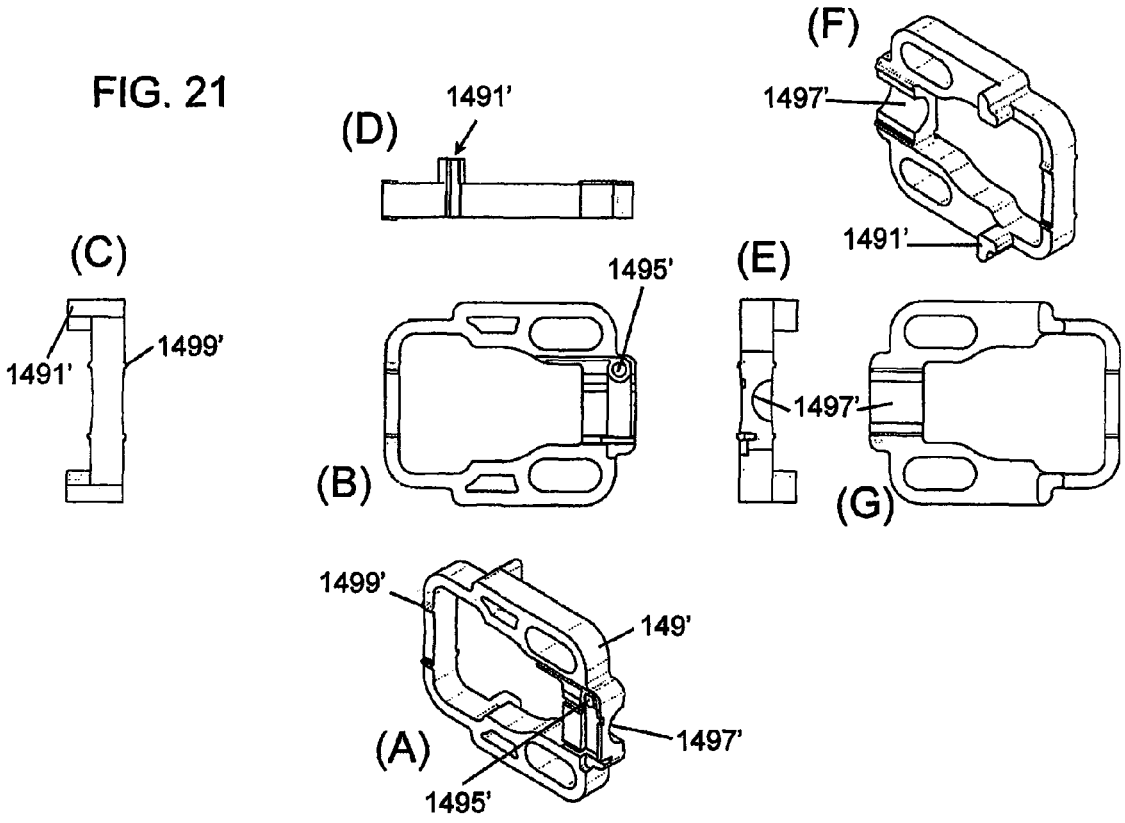
FIGS. 21A-G illustrate views of a sliding mechanism (A) a perspective view, (B) a top view, (C) a left side view, (D) a front view, (E) a right side view, (F) an opposite perspective view, and (Q) a bottom view.

FIG. 18 illustrates an exploded view of a portion 102' of a magnetic gate latch showing how the components of the portion are assembled. The sliding mechanism 149' has a pin 1495' for retaining a torsion spring 1494' that engages a protrusion 1087' extending from the back plate 108' as illustrated in FIGS. 20A-B. The back plate of FIGS. 20A-B has a second structure 1082' that may engage the ends of a second torsion spring 109' that provides a bias for returning the handle 118 to a neutral position. As illustrated in FIG. 18, a portion of the handle 118 extends through the housing 102' and is retained by a retaining C-clip 106. FIGS. 19A-C illustrate perspective views and an exploded view of the keeper 120' having a mounting plate 128' and a keeper housing and retainer 1221' enclosing a magnet 122', such as a one inch diameter and one inch length of a neodymium-iron-boron. A recessed portion provides a retainer for the pin ISO' of the magnetic gate latch that extends from the housing 102' when aligned with the magnet 122' of the keeper 120'. FIGS. 20A-B and 21A-G illustrate detail views of a back plate 108' and a sliding mechanism 149'. The pin is retained between an arcuate portion 1497' of the sliding mechanism, such as illustrated in FIGS. 21 A, E-G and an arcuate portion 1020' of the housing, such as illustrated in FIG. 14B. The opposite side of the sliding mechanism faces the backing plate 108'. The protruding portion 1087' engages a torsion spring 1494' retained on a pin 1495' of the sliding mechanism 149'. Spacers 1499' are provided to reduce friction between the sliding mechanism and both the back plate and the housing. Protrusions 1491' are spacers that provide the appropriate distance between the housing and the sliding mechanism. When assembled with the housing, the portion of the magnetic latch illustrated in FIGS. 16A-B provide a pin that extends when aligned with a magnet in the keeper, and is withdrawn from the keeper by turning the handle. The handle turns the cam actuator 140', which slides the sliding mechanism 108', engaging the collar 1511' of the pin and withdrawing the pin. The torsion spring 1494' does not withdraw the pin from the retaining portion of the keeper. Instead, the torsion spring is capable of moving the sliding mechanism a short distance, such that the pin is retained within the keeper. The sliding mechanism and pin are positioned by the torsion spring 1494' close enough to the arcuate plate 142 in the cam actuator 140' such that the magnetic force of a magnet in the pin is sufficiently strong to retract the pin and to retain the pin within the housing due to the force of magnetism between the magnet 1507' and the arcuate metal strip 142 of the cam actuator 140', for example. Thus, the mechanism for disengaging the pin from the keeper is the turning of the handle, but the magnetic force between the pin and the actuator cam retains the pin within the housing until the pin is returned into alignment with the keeper. Then, when the pin is aligned with the keeper, the pin is drawn from the housing by the magnetic force between the magnet of the keeper and the pin and the gate is latched.

Alternative combinations and variations of the examples provided will become apparent based CHI this disclosure. It is not possible to provide specific examples for all of the many possible combinations and variations of the embodiments described, but such combinations and variations may be claims that eventually issue. Although the claims and the examples in the detailed description refer to a gate, the term gate is meant to be interpreted broadly as a door or other device that may be hingedly opened and closed by a user, and the invention is not limited to gates used in fencing and the like.

What is claimed is:

1. A gate latch assembly, comprising:

a housing;

a handle coupled to the housing;

a retractor disposed within the housing such that the retractor is slidable forward and backward within the housing;

a latching mechanism operatively coupled with the retractor such that, when the retractor slides backward, the latching mechanism is engaged by the retractor, drawing a portion of the latching mechanism into the housing;

an actuator assembly having a neutral position, wherein the actuator assembly includes a portion disposed in relation to the latching mechanism such that the latching mechanism is magnetically attracted to the portion as the actuator assembly is rotated by the handle from the neutral position; and a biasing mechanism, wherein the biasing mechanism is coupled with the actuator assembly, the retractor or both the actuator assembly and the retractor such that the biasing mechanism applies a mechanical force to the actuator assembly, tending to return the actuator assembly to the neutral position, when the handle is released, wherein the latching mechanism comprises a pin operatively coupled with the retractor such that, as the retractor slides backward, the pin is pulled by the retractor into an unlatched position, and as the retractor returns forward, the pin is capable of being retained in the unlatched position and, wherein the pin includes a magnet providing a magnetic force for retaining the pin in contact with the portion of the actuator assembly disposed in relation to the latching mechanism such that the latching mechanism is magnetically attracted to the portion as the actuator assembly is rotated in either direction by the handle from the neutral position, the portion of the actuator comprising a ferromagnetic material.

2. The device of claim 1, wherein the portion disposed in relation to the latching mechanism comprises an arcuate strip.

3. The device of claim 2, wherein the arcuate strip comprises steel.

4. The device of claim 2, wherein the arcuate strip is a composite material comprised of a ferromagnetic material and a non-ferromagnetic material.

5. The device of claim 4, wherein the non-ferromagnetic material is a dielectric.

6. The device of claim 5, wherein a first portion of the arcuate strip is formed of the dielectric, and the first portion of the arcuate strip is disposed such that the first portion is in contact with the second magnet, when the actuator mechanism is disposed in a neutral position.

7. The device of claim 6, wherein the first portion of the arcuate strip is disposed between a second portion and a third portion, the second portion and the third portion being comprised of the ferromagnetic material, such that, as the actuator is displaced from the neutral position, the second magnet comes into direct contact with either the second portion or the third portion of the arcuate strip, increasing the force of magnetic attraction between the second magnet and the arcuate strip.

8. The device of claim 7, wherein the pin is not biased in any direction by a spring.

9. The device of claim 1, wherein the pin is not biased in any direction by a spring.

10. A method of using the device of claim 1, comprising:

turning the handle, such that the latching mechanism is magnetically attracted to the portion of the actuator assembly as the actuator assembly is rotated by the handle from the neutral position, wherein the retractor moves backward in the housing, and the pin is pulled by the retractor into the unlatched position and is retained in the unlatched position by a magnetic attraction between the magnet of the pin and the ferromagnetic material of the portion of the actuator assembly as the handle is turned in either direction;

pulling or pushing on the handle to open a structure on which the device is mounted;

releasing the handle, sliding the retractor forward in the housing, automatically, when the handle is released, while the pin remains magnetically attracted to the ferromagnetic material by the magnet of the pin, retaining the magnet in contact with the ferromagnetic material, as the retractor moves forward; and returning the actuator assembly to the neutral position, while the pin remains in the unlatched position.

11. The method of claim 10, further comprising:

closing the structure, such that the pin becomes disposed over a keeper, the keeper comprising a magnet, such that the pin is pulled automatically into a latched position by the magnetic attraction between the pin and the magnet of the keeper, when the pin is aligned over the keeper.

* * * * *